US009769572B2

(12) United States Patent
Jiang et al.

(10) Patent No.: US 9,769,572 B2
(45) Date of Patent: Sep. 19, 2017

(54) TABLET WOOFER AND ELECTRONIC DEVICE USING SAME

(71) Applicant: Goertek Inc., Shandong (CN)

(72) Inventors: Chao Jiang, Shandong (CN); Jianbin Yang, Shandong (CN); Zhi Li, Shandong (CN); Qijin Jiao, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 14/890,073

(22) PCT Filed: May 31, 2013

(86) PCT No.: PCT/CN2013/076552

§ 371 (c)(1),
(2) Date: Nov. 9, 2015

(87) PCT Pub. No.: WO2014/180014

PCT Pub. Date: Nov. 13, 2014

(65) Prior Publication Data

US 2016/0127835 A1 May 5, 2016

(30) Foreign Application Priority Data

May 8, 2013 (CN) ..... 2013 1 0167054
May 8, 2013 (CN) ..... 2013 1 0167181
May 8, 2013 (CN) ..... 2013 1 0168974

(51) Int. Cl.
*H04R 7/04* (2006.01)
*H04R 9/06* (2006.01)
(Continued)

(52) U.S. Cl.
CPC ..... *H04R 9/063* (2013.01); *H04R 9/045* (2013.01); *H04R 7/127* (2013.01); *H04R 7/18* (2013.01);
(Continued)

(58) Field of Classification Search
CPC ..... H04R 1/06; H04R 7/04; H04R 9/063
See application file for complete search history.

(56) References Cited

U.S. PATENT DOCUMENTS 1,872,799 A * 8/1932 Pare ..... H04R 9/063 181/147
4,122,314 A * 10/1978 Matsuda ..... H04R 7/02 181/170
(Continued)

FOREIGN PATENT DOCUMENTS

CN 1121678 5/1996
CN 101175338 5/2008
(Continued)

OTHER PUBLICATIONS

English Translation of First Office Action for Chinese Application No. 1020157034776.
(Continued)

*Primary Examiner* — Quoc D Tran
*Assistant Examiner* — Ryan Robinson
(74) *Attorney, Agent, or Firm* — Alix, Yale & Ristas, LLP

(57) ABSTRACT

A tablet woofer and an electronic device using same. The woofer comprises a vibrating diaphragm, at least four mutually independent drive units, and a housing. The vibrating diaphragm is a rectangle shape, and comprises a rigid arc portion at the central position and a spiral curve portion at the periphery; the drive unit comprises a voice coil unit and a corresponding magnetic circuit unit, and four angles of the arc portion of the vibrating diaphragm are each combined with one voice coil unit; the housing is provided with mounting holes for accommodating and mounting the drive units, and sound holes penetrating through the mounting plane; the spiral curve portion of the vibrating diaphragm is
(Continued)

fixedly connected to the periphery of the upper side of the housing.

16 Claims, 9 Drawing Sheets

(51) Int. Cl.
*H04R 9/04* (2006.01)
*H04R 7/12* (2006.01)
*H04R 7/18* (2006.01)

(52) U.S. Cl.
CPC ..... *H04R 2499/11* (2013.01); *H04R 2499/15* (2013.01)

(56) References Cited

U.S. PATENT DOCUMENTS

| | | | | |
|---|---|---|---|---|
| 4,252,211 | A * | 2/1981 | Matsuda | H04R 1/22 181/166 |
| 5,025,474 | A * | 6/1991 | Tanaka | G03B 21/565 181/148 |
| 5,682,436 | A | 10/1997 | Sakamoto et al. | |
| 7,548,766 | B2 * | 6/2009 | Takahata | H04R 1/02 181/172 |
| 2011/0019865 | A1 | 1/2011 | Onodera | |

FOREIGN PATENT DOCUMENTS

| | | |
|---|---|---|
| CN | 101860783 | 10/2010 |
| CN | 201616902 | 10/2010 |
| CN | 101984677 | 3/2011 |
| CN | 103260116 | 8/2013 |
| CN | 103260118 | 8/2013 |
| CN | 103269471 | 8/2013 |
| CN | 103231657 | 9/2013 |
| CN | 103281656 | 9/2013 |
| CN | 103297903 | 9/2013 |
| CN | 203279157 | 11/2013 |
| CN | 203279158 | 11/2013 |
| CN | 203368735 | 12/2013 |
| CN | 203368736 | 12/2013 |
| CN | 203368737 | 12/2013 |
| CN | 203368738 | 12/2013 |
| JP | S5476131 | 6/1979 |

OTHER PUBLICATIONS

English Translation of Second Office Action for Chinese Application No. 2015121001380390.
English Translation of Second Office Action for Chinese Application No. 2015122501355850.
English Translation of Second Office Action for Chinese Application No. 2016021701297870.
English Translation of Third Office Action for Chinese Application No. 2016052001332260.
English Translation of Third Office Action for Chinese Application No. 2016072001505040.

* cited by examiner

TABLET WOOFER AND ELECTRONIC DEVICE USING SAME

TECHNICAL FIELD

The present invention relates to the acoustoelectric technical field; more specifically, to a tablet woofer and electronic device using the same.

BACKGROUND

With the social progress and technical development, electronic products such as TV are gradually thinned in recent years. People are increasingly demanding high performance of these electronic products, so the supporting electronic parts are required to be smaller in size and thickness and improved in performance and consistency.

The woofer is an important electronic component which is widely used in the above electronic products, in the thin-type electronic devices such as liquid crystal televisions, laptop computers and the like. It is required to reduce the thickness thereof on the basis of ensuring loudspeaker performance to meet the need for thin-type electronic devices.

The woofer with traditional structure normally uses a tapered paper cone vibrating diaphragm. The tapered vibrating diaphragm comprises a voice coil in the central position thereof, and the size of the magnetic circuit system is relatively large and thick. The woofer with this structure is too thick to meet the requirement of gradually-thinned electronic products at present, and is weak on practicability.

Besides, the woofer usually has a larger caliber (i.e. larger area of vibrating diaphragm) to ensure the low-frequency sound effect thereof. If the structure in which a tabulate vibrating diaphragm combined with a voice coil (the voice coil is required to be positioned near the edge) is adopted, the vibrating diaphragm with larger area requires the voice coil to be large in size, causing difficult winding and easy deformation. Further, the magnet of the existing woofer is large in size, and the thicknesses of washers and frames are required to be smaller during thinned application, so the magnetic circuit system is easy to be saturated, and the magnet performance is excessive, leading to wastage and relatively high cost.

Based on the above factors, there is a need to improve the woofer with traditional structures to avoid the aforementioned defects.

SUMMARY

In view of the above problems, the present invention aims to provide a tablet woofer to realize thinning of woofers and solve the problems of thick and heavy voice coils and excessive magnet performance.

A tablet woofer is provided, comprising a vibrating diaphragm, at least four mutually independent driving units and a housing, wherein:

the vibrating diaphragm has a rectangular shape, comprising a rigid dome portion at the central position and a suspension ring portion at the periphery;

the driving unit comprises a voice coil unit and a magnetic circuit unit corresponding to the voice coil unit;

four voice coil units are bonded to four corners of the dome portion of the vibrating diaphragm respectively;

mounting holes for accommodating and mounting the driving units, and sound holes penetrating through the mounting plane are arranged on the housing; and the suspension ring portion of the vibrating diaphragm is fixed and coupled to the peripheral region of the upper lateral surface of the housing.

Moreover, the preferred scheme is that, the housing comprises a mounting plane and an annular side wall arranged on the periphery of the mounting plane, mounting holes for accommodating and mounting the driving units and sound holes penetrating through the mounting plane are arranged on the mounting plane, and the upper side surface of the annular side wall is fixedly connected with the suspension ring portion of the vibrating diaphragm.

Moreover, the preferred scheme is that, the driving unit has a round shape, comprises a rounded voice coil unit and a rounded magnetic circuit unit; and the voice coil unit is bonded to the side of the dome portion proximate to the housing.

Moreover, the preferred scheme is that, the sound holes comprise central sound holes arranged at the central position of the mounting plane and edge sound holes arranged between the annular side wall and the mounting holes.

Moreover, the preferred scheme is that, the number of the driving units is at least six, the voice coil units of four driving units among the driving units are bonded to four corners of the dome portion of the vibrating diaphragm respectively, and the other voice coil units are respectively bonded to one or two groups of opposite sides of the dome portion.

Moreover, the preferred scheme is that, the voice coil units which are bonded to either side of the dome portion and two voice coil units which are bonded to the corners of the same side, are equally spaced along a same straight line; or the spacing between the two voice coil units bonded to central positions of the opposite straight sides of the dome portion is less than the spacing between the two voice coil units bonded to the corners of the dome portion.

Additionally, the preferred scheme is that, the tablet woofer further comprises FPCB connectors electrically connected with the internal circuit of the woofer and the external circuit, wherein, the FPCB connector is clamped and fixed on the mounting plane on the edge of the central sound hole, or attached and fixed to the side of the vibrating diaphragm combined with the voice coil unit; and one part of the FPCB connector is positioned at the side of the mounting plane near the vibrating diaphragm, and the other part is positioned at the side of the mounting plane away from the vibrating diaphragm.

Additionally, the preferred scheme is that, the voice coil units are electrically connected in the following manner: connecting sequentially voice coil units positioned at each side in series respectively so as to have two branches, and then connecting the two branches in parallel; or connecting sequentially voice coil units positioned at the different sides in series respectively so as to have two branches, and then connecting the two branches in parallel.

Additionally, the preferred scheme is that, a fixing plane is provided on the extension of the outer edge of the annular side wall, and fixing holes for coupling with electronic devices are provided on the fixing plane.

Additionally, the preferred scheme is that, the dome portion has a honeycomb structure or a foaming body structure; the suspension ring portion is made of PU or silicon rubber; the housing is made of aluminum alloy material.

On the other hand, an electronic device is provided comprising the above tablet woofer and a peripheral frame for fixing the woofer, wherein, a rear acoustic cavity is formed between the peripheral frame and the woofer; the rear acoustic cavity is communicated with the space behind the vibrating diaphragm through the sound hole.

Additionally, the preferred scheme is that, the acoustic absorbing material or gas adsorption material is provided in the rear acoustic cavity.

It can be seen from the above technical scheme that the tablet woofer can achieve the following beneficial effects:

1) a driving unit is provided at each of the four corners of the dome portion of the vibrating diaphragm, such a structure uses small-size voice coils and magnetic circuits to drive the large-size vibrating diaphragm of the woofer, which can reduce the thickness of the woofer, reduce cost while saving the size of magnets, and improve the sensitivity of the loudspeaker; besides, the structure that the driving units are arranged at the corners is beneficial to driving the vibrating diaphragm of the woofer in equilibrium;

2) the housing uses aluminum alloy materials which are high in strength and high in stability;

3) the voice coils and external circuit are connected by FPCB (Flexible Printed Circuit Board, shorted for FPCB or FPC), which can save space; and the lead wires of the voice coils bonded to the vibrating diaphragm are directly connected with the pads of the FPCB connector by soldering, so that the disconnection of the leading wires of the voice coils due to vibration of the vibrating diaphragm can be avoided.

Some exemplary aspects of the present invention are described in details by the description below and the accompanying drawings. However, these aspects only indicate some implementations of various implementations of the present invention. In addition, the present invention intends to include all these aspects and their equivalents.

BRIEF DESCRIPTION OF THE DRAWINGS

By referring to the descriptions taken in conjunction with the accompanying drawings and the contents of the claims, and with a full understanding of the present invention, other purposes and results of the present invention will be more clearly and easily understand wherein:

Figure 1:
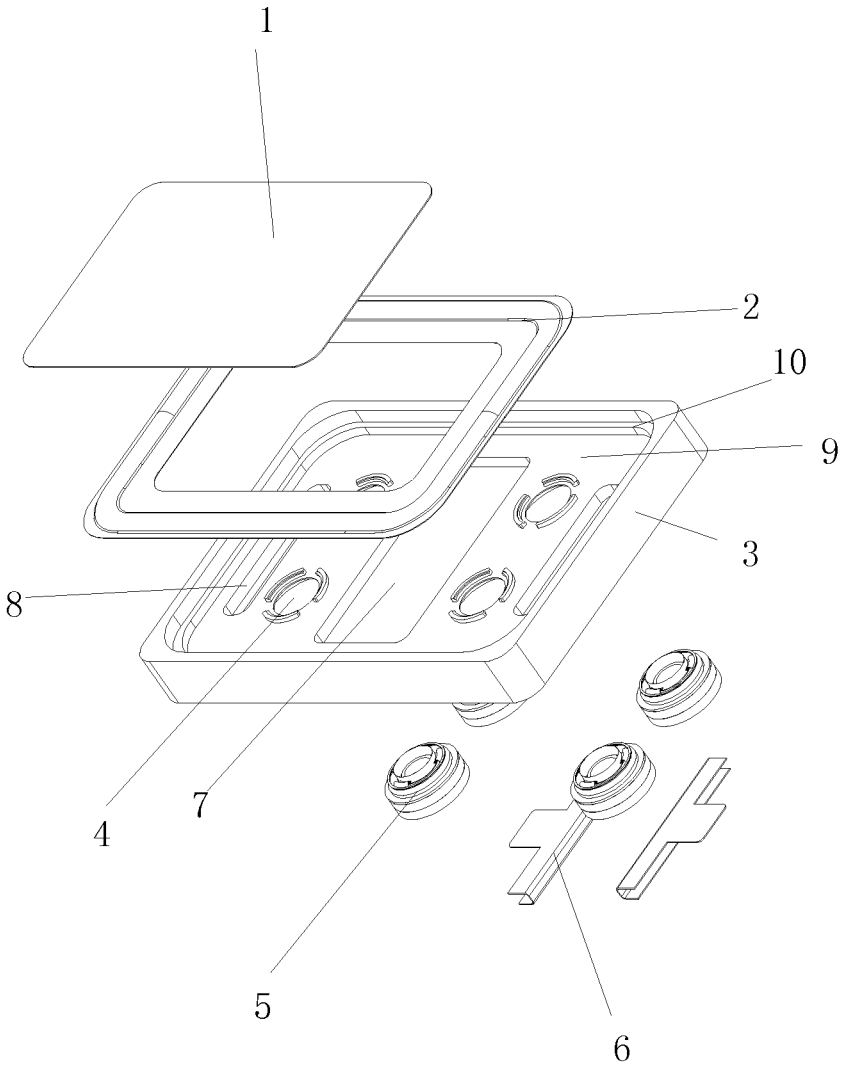
FIG. 1 is a structural schematic diagram of a tablet woofer according to embodiment I.

The reference numbers of the appended drawings comprise: dome portion 1, suspension ring portion 2, housing 3, mounting hole 4, driving unit 5, FPCB connector 6, central sound hole 7, edge sound hole 8, mounting plane 9, annular side wall 10, voice coil 11, voice coil bobbin 12, center suspension 13, washer 14, magnet 15, T-shaped iron 16, magnetic gap 17, vibrating diaphragm 18, peripheral frame 19, woofer 20, rear acoustic cavity 21.

Similar reference numerals in all figures indicate similar or same features or functions.

DETAILED DESCRIPTION

Various specific details are set forth in the following description to comprehensively understand one or more embodiments for sake of illustration. However, it is obvious that these embodiments can be implemented without such specific details. Particular embodiments of the present invention will be described in connection with the accompanying drawings.

The woofer needs a large area of the vibrating diaphragm. In order to provide enough driving to the large-area vibrating diaphragm while limiting the size of voice coils and magnets, the present invention starts from the perspective of dispersedly arranging multiple driving units independent of each other, so that the vibrating diaphragm is driven by multiple independent voice coils and each voice coil corresponds to independent magnetic circuit unit, thus realizing thinning of the woofer with more reasonable and effective driving unit arranging structures.

FIG. 1 is a structural schematic diagram of the tablet woofer according to embodiment I of the present invention.

As shown in FIG. 1, the tablet woofer comprises a vibrating diaphragm, at least four mutually independent driving units 5 and a housing 3 for fixing and encapsulating the vibrating diaphragm and the driving unit 5.

The vibrating diaphragm has a rectangular shape, which may be oblong or square. The vibrating diaphragm comprises a rigid dome portion 1 of the vibrating diaphragm at the central position and a suspension ring portion 2 of the vibrating diaphragm at the edge position, and the suspension ring portion 2 of the vibrating diaphragm is fixed to and coupled to the peripheral region of the upper side surface of the housing 3.

The driving unit 5 comprises a voice coil unit and a magnetic circuit unit. Each voice coil unit corresponds to each magnetic circuit unit. The tablet woofer of embodiment I comprises four driving units, the four driving units 5 can be arranged at four corners of the dome portion 1 of the vibrating diaphragm respectively; if the tablet woofer comprises more than four driving units, except for the voice coil units bonded to the four corners of the dome portion of the vibrating diaphragm respectively, the remaining voice coil units of the driving units can be uniformly arranged at the remaining positions of the dome portion 1 of the vibrating diaphragm or arranged on the dome portion in a disperse and irregular manner to avoid resonance.

The housing 3 comprises a mounting plane 9 and an annular side wall 10 around the mounting plane. Fixing holes (not shown in FIG. 1) are arranged on the edge of the annular side wall. The fixing holes are used for fixing and coupling the tablet woofer and electronic devices. The fixing holes can be arranged at the side of the annular side wall away from the vibrating diaphragm, or arranged on the fixing plane which extended from the outer edge of the annular side wall and has an annular shape, so as to combine the woofer with the electronic device.

Mounting holes 4 with the number and position corresponding to the driving units, and sound holes penetrating through the mounting plane are arranged on the mounting plane 9. The mounting holes 4 are used for accommodating the voice coil units and mounting and fixing the magnetic circuit units. The sound hole comprises central sound holes 7 and edge sound holes 8. The central sound hole 7 is arranged in the central position of the mounting plane 9 corresponding to the intermediate region of the vibrating diaphragm. The edge sound hole 8 is arranged between the annular side wall 10 and the mounting holes 4. With respect to the whole mounting plane, the edge sound hole 8 is arranged on the edge corresponding to the central sound hole 7.

In the embodiment shown in FIG. 1, the edge sound hole 8 is strip-shaped and arranged on the mounting plane parallel to the central sound hole 7. Of course, the edge sound holes can be designed to have a round or other irregular shapes according to the application requirement of the loudspeaker.

The upper side surface of the annular side wall 10 is fixedly connected with the suspension ring portion 2 of the vibrating diaphragm.

Four driving units 5 shown in the embodiment I are electrically connected by the FPCB connector 6. In this embodiment, the FPCB connector 6 is T-shaped, clamped and fixed on the mounting plane 9 on the edge of the central sound hole 7. Multiple welding pads (not shown in FIG. 1) are arranged on the FPCB connector 6. The welding pads are connected with the voice coils and the external circuit.

As the FPCB connector 6 is clamped and fixed on the mounting plane, one part of the FPCB connector is positioned at the side of the mounting plane 9 closer to the vibrating diaphragm, and the other part is positioned at the side of the mounting plane 9 away from the vibrating diaphragm.

As many driving units are used in the present invention, the driving units and the external circuit are electrically connected by the FPCB connector in the embodiments of the present invention. Compared to ordinary lead wire connecting manners, using the FPCB connector can simplify the manufacturing process, save the internal space of the loudspeaker and improve the stability of the loudspeaker.

Figure 2:
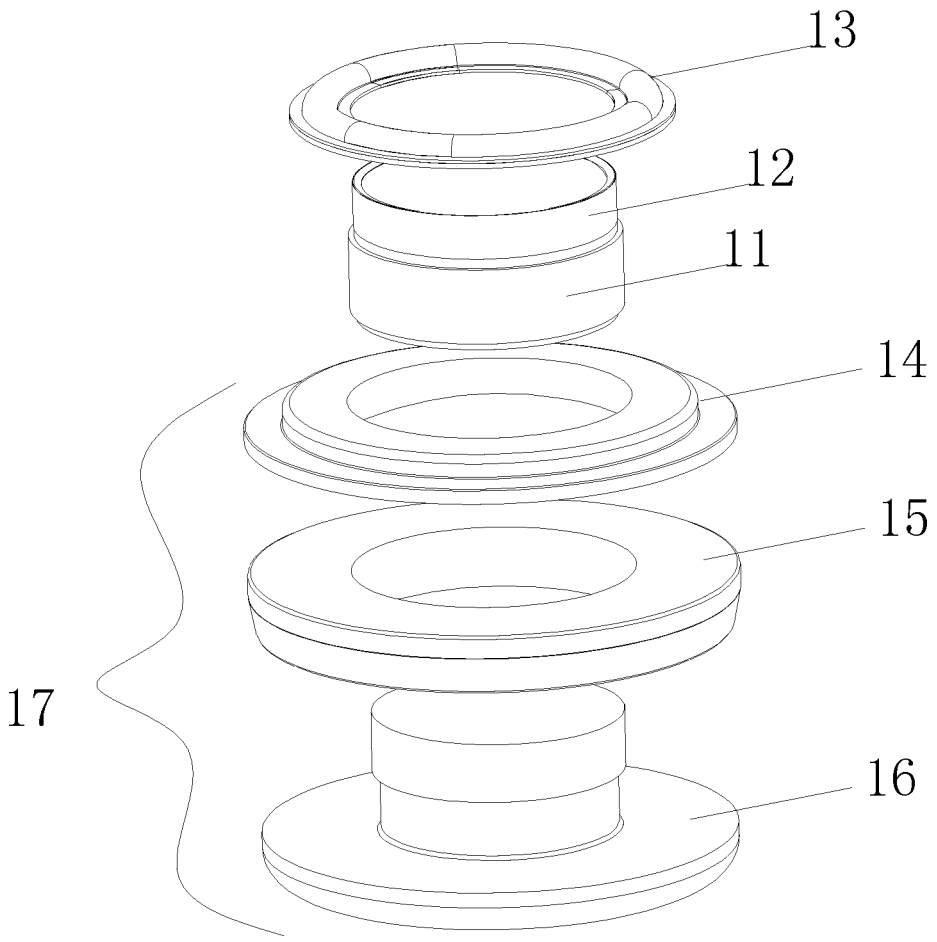
FIG. 2 is a structural schematic diagram of a driving unit according to embodiment I.
Figure 3:
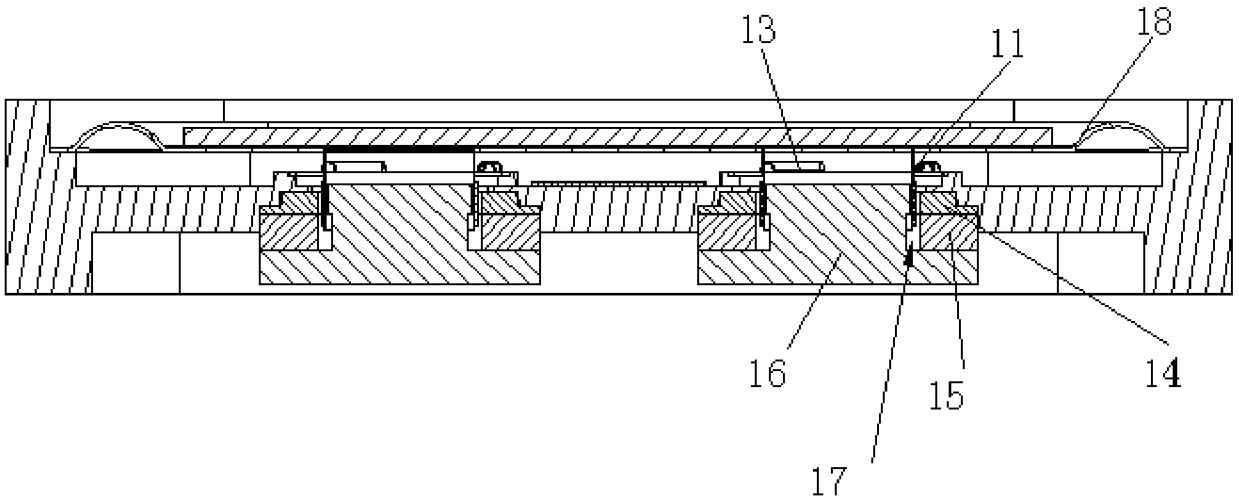
FIG. 3 is a sectional view of the woofer according to embodiment I.

FIG. 2 and FIG. 3 are structural schematic diagram and sectional view of driving units according to the embodiment I of the present invention, respectively. As shown in FIG. 2 and FIG. 3, the driving unit comprises a voice coil unit and a magnetic circuit unit. Wherein, the voice coil unit comprises a voice coil 11, a voice coil bobbin 12 and a center suspension 13, and the magnetic circuit unit comprises a washer 14, a magnet 15 and a T-shaped iron 16.

The voice coil 11 and the vibrating diaphragm 18 are combined and fixed. The voice coil bobbin 12 is used for supporting the voice coils 11, so that the voice coils 11 are on a proper position in the magnetic gap 17. The center suspension 13 is used for fixing the voice coils 11 to prevent the voice coils 11 from polarizing in the horizontal direction.

The driving units in the embodiment shown in FIG. 2 and FIG. 3 have round structures, which can ensure that the vibrating diaphragm 18 is stressed more uniformly compared to the driving units with a strip-shaped structure. Both the washer 14 and the T-shaped iron 16 have magnetic conductive structures for modifying magnetic lines of force; and the magnetic gap 17 formed between the magnet 15 and the T-shaped iron 16 is used for accommodating the voice coils 11.

For the structures of the loudspeakers with four driving units showed in embodiment I, to ensure that the FPCB connectors can be conveniently fixed and attached to the housing as well as conveniently connect multiple voice coils, multiple welding pads and circuits connected with the welding pads can be arranged on the surface of the FPCB connector, and the voice coils are electrically connected with the welding pads at the side of the FPCB connector closer to the vibrating diaphragm through spot welding or the like. During connection, by using the circuits between the welding spots, the voice coils can be flexibly connected in series, in parallel or the combination of series and parallel. Electronic devices (such as televisions) are electrically connected with the side of the FPCB connector away from the mounting plane, and the FPCB connector is clamped and fixed on the mounting plane on the edge of the central sound holes, so that the limited internal space of the loudspeaker can be fully utilized.

The dome portion 1 of the vibrating diaphragm has a rigid structure which can improve the acoustic property of the vibrating diaphragm. In the embodiments of the present invention, the dome portion 1 of the vibrating diaphragm can have a honeycomb structure or a foaming body structure which can also improve the acoustic property of the vibrating diaphragm. The suspension ring portion 2 of the vibrating diaphragm is made of PU (Polyurethane) or silicon rubber.

In the embodiment of four driving units of the embodiment I, four driving units 5 are respectively arranged on the positions of the vibrating diaphragm corresponding to the dome portion 1, which is beneficial to stable combination of the voice coils of the driving units 5 and the vibrating diaphragm, preferably, positioned at four corners of the dome portion 1, so that the vibrating diaphragm can be driven in equilibrium. In this structure, small-size voice coil units and magnetic circuit units are used to drive the large-size vibrating diaphragm of the woofer, which can reduce the thickness of the woofer, reduce cost while saving the size of magnets, and improve the sensitivity of the woofer. Four driving units 5 acting on the vibrating diaphragm with uniform driving force can ensure enough high driving power on the basis of reducing the size of the driving units, so that the products are more thinned. Such performance ensures that the tablet woofer of the present invention can be applied to electronic devices with relatively higher power, such as a liquid crystal display television.

Figure 4:
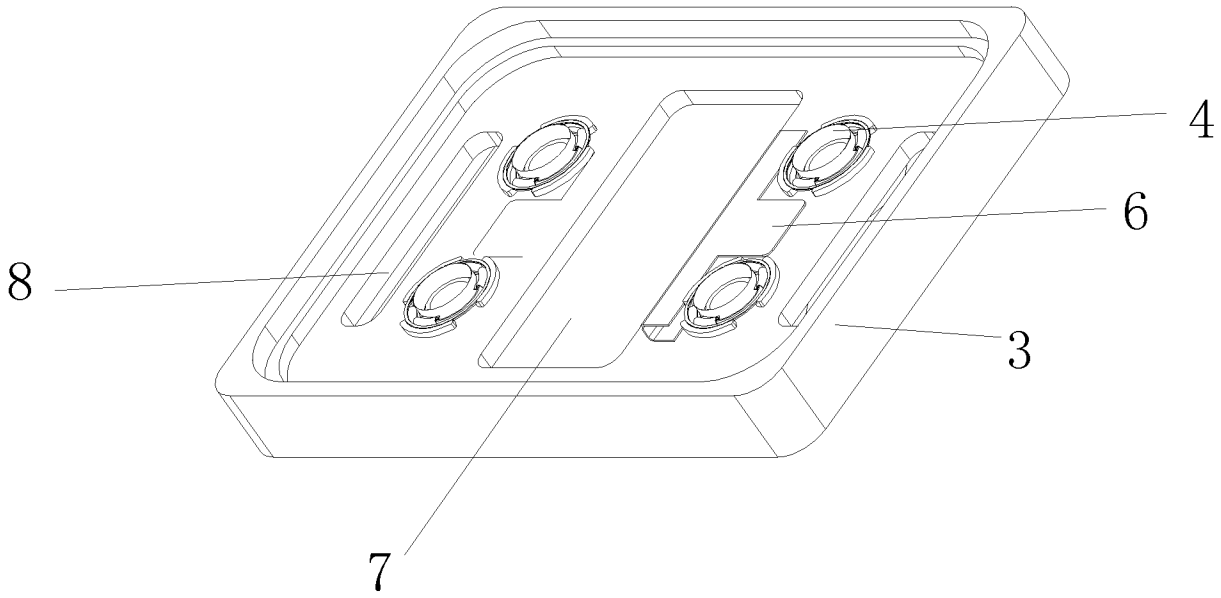
FIG. 4 is an opposite view of the housing and the driving units according to embodiment I.

FIG. 4 is an opposite view of the housing and the driving units according to embodiment I of the present invention.

As shown in FIG. 4, the housing 3 comprises a mounting plane and an annular side wall. Four mounting holes 4 for accommodating the driving units and sound holes are arranged on the mounting plane; wherein, the housing 3 is made of plastic material or metal material, preferably, of aluminum alloy materials which are high in strength and stability. The sound holes comprise central sound holes 7 and edge sound holes 8.

In the embodiment shown in FIG. 4, the central sound hole 7 is arranged on the mounting plane corresponding to the intermediate region of the vibrating diaphragm. For the rectangular vibrating diaphragm, if four voice coils are arranged in the edge position, the intermediate region of the vibrating diaphragm is relatively large, and this part of vibrating diaphragm generates much airflow. Therefore, central sound hole 7 is arranged on the mounting plane corresponding to this part, and the size of the central sound hole 7 is large so that much airflow flows in or out through the central sound hole. Besides, the edge sound holes 8 are arranged in the edge position of the mounting plane corresponding to the central sound hole 7.

The FPCB connector 6 is used for electrically connecting the driving units and the external circuit, and the FPCB connector 6 used in the present invention has a rigid structure which has strong elasticity and is unlikely to be ruptured compared to the existing plastic structures.

Besides, fixing holes (not shown in FIG. 4) are further arranged at four corners of the housing 3 for fixing the woofer and electronic devices.

Figure 5:
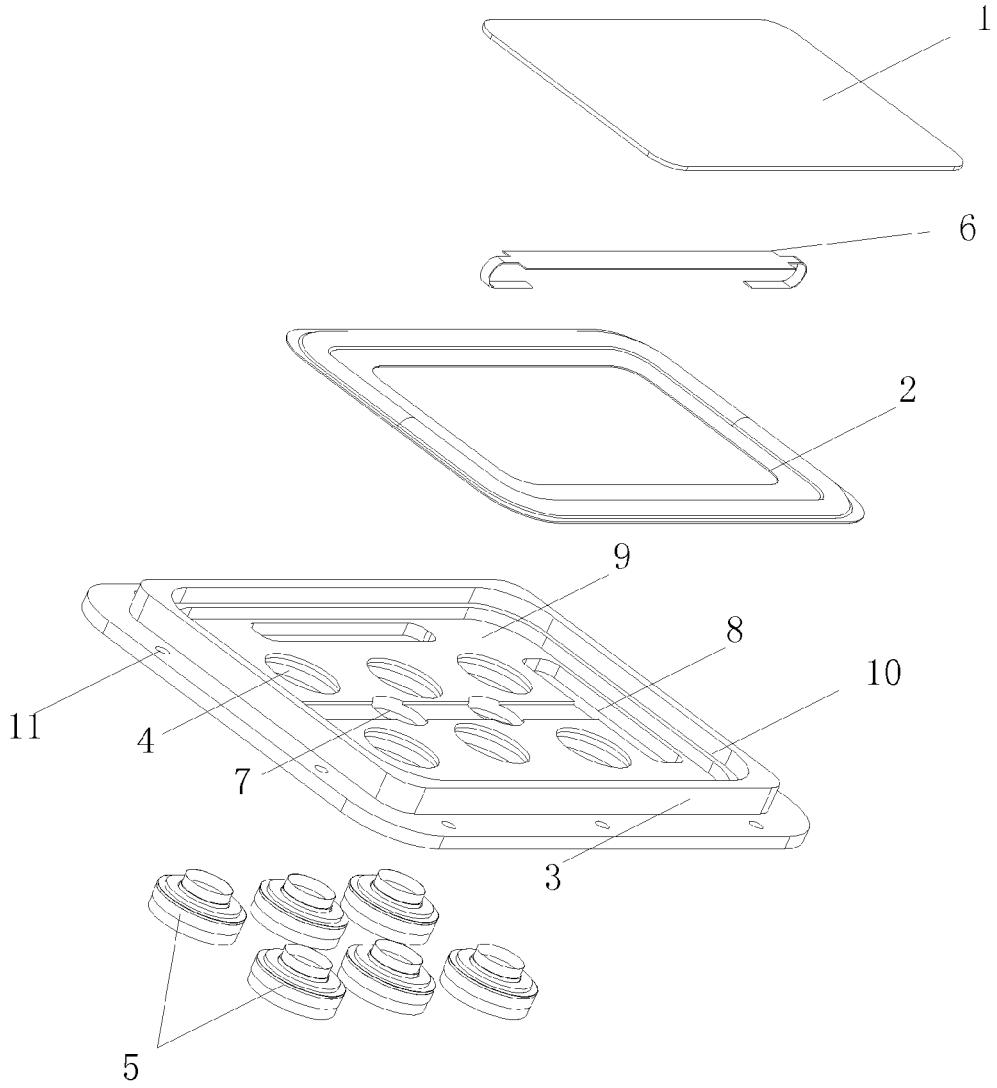
FIG. 5 is a structural schematic diagram of a tablet woofer according to embodiment II.
Figure 6:
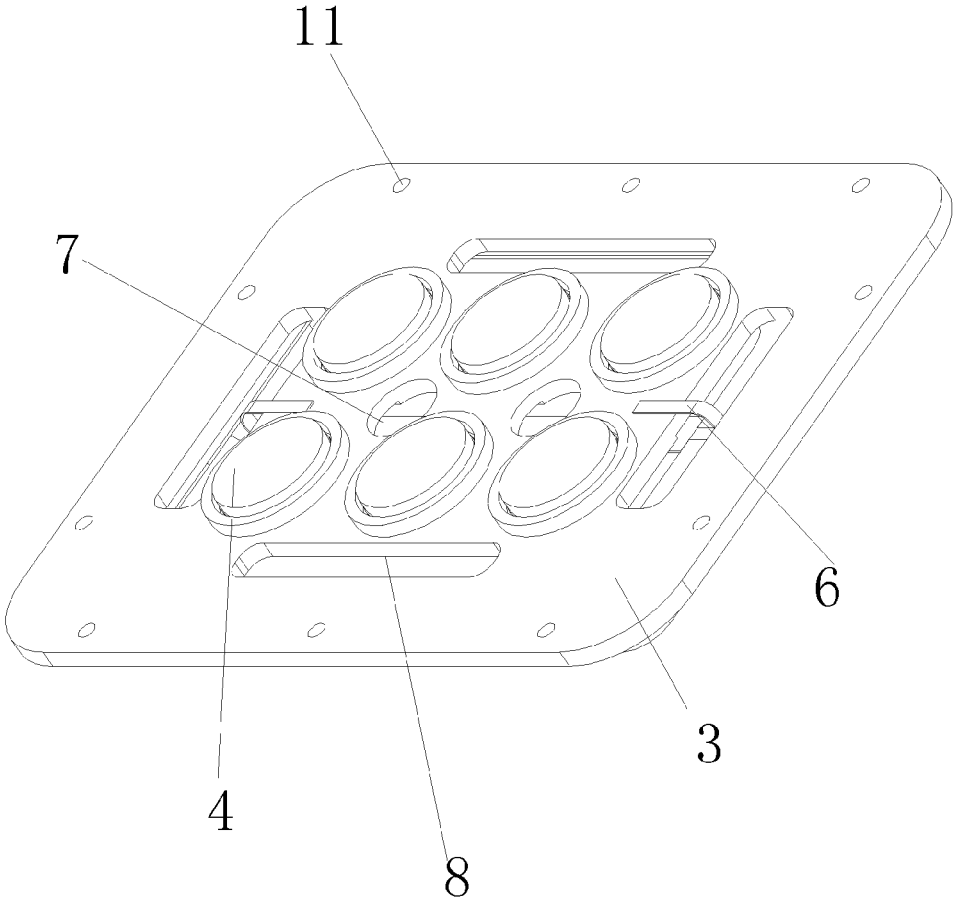
FIG. 6 is an opposite view of the housing and the driving units according to embodiment II.

FIG. 5 is a view showing the structure of a tablet woofer according to embodiment II of the present invention, and FIG. 6 is an opposite view showing the housing and the driving units of the tablet woofer according to embodiment II of the present invention.

As shown in FIG. 5 and FIG. 6, the tablet woofer of embodiment II comprises a vibrating diaphragm, at least six mutually independent driving units 5 and a housing 3 for fixing and encapsulating the vibrating diaphragm and the driving units 5.

Similar to embodiment I, the vibrating diaphragm of the tablet woofer of embodiment II also has a rectangle shape, and comprises a rigid rectangle dome portion 1 at the central position and a suspension ring portion 2 at the edge position, and the suspension ring portion 2 of the vibrating diaphragm is fixed and coupled to the peripheral region of the upper side surface of the housing 3. In order to enlarge the effective vibrating area of the vibrating diaphragm, the ratio of the equivalent radius of the effective radiating area of the rectangle dome portion 1 to the width of the suspension ring portion is in the range of 4 to 15, i.e., 4<equivalent radius of the effective radiating area:width of the suspension ring portion<15.

There are six driving units in embodiment II, which is different from embodiment I. Four voice coil units are bonded to four corners of the rectangle dome portion of the vibrating diaphragm respectively, and the other two voice coil units are respectively bonded to one group of opposite sides formed by the voice coil units at four corners. The voice coil unit which is bonded to either side of the dome portion and two voice coil units which are bonded to the corners of the same side, are equally spaced along a same straight line, so as to form larger driving force to act on terminal product with higher power.

According to the structural design ideals of embodiments I and II, when more driving units are provided in the tablet woofer, except that a voice coil unit is bonded to each of the four corners of the dome portion of the vibrating diaphragm respectively, the rest of the voice coil units can be bonded to one or two groups of opposite sides of the dome portion respectively, so as to make all the voice coils being uniformly attached and fixed to the dome portion of the vibrating diaphragm, thereby acting together with the magnetic circuit units to drive the vibrating diaphragm to vibrate with uniformly distributed driving force.

In the embodiment II showed in FIGS. 5 and 6, the sound holes in the mounting plane 9 comprise two round central sound holes 7 and four strip-shaped edge sound holes 8. The central sound holes 7 are arranged among every four adjacent mounting holes 4. The number of the edge sound holes 8 is four, arranged between four sides of the annular side wall and the mounting holes 4, respectively. In the embodiment showed in FIG. 1, the edge sound holes 7 are strip-shaped, and the central sound holes 8 are round. Of course, the central sound holes can be designed to be rhombus or square shapes, and the edge sound holes can be designed to be round or other irregular shapes according to the application requirement of the loudspeaker.

The FPCB connector 6 of embodiment II is strip-shaped, and its middle part is attached to the side of the vibrating diaphragm provided with the voice coils, and two end parts of the connector extend from the sound hole to the side of the mounting plane 9 away from the vibrating diaphragm. The leading wires of the voice coils are electrically connected with the pads of the FPCB connector 6 at the side of the mounting plane closer to the vibrating diaphragm, and electronic devices, such as televisions and the like, are electrically connected with the FPCB connector at the side of the mounting plane apart from the vibrating diaphragm. With such a structure, the limited internal space of the loudspeaker can be fully used. Additionally, parts of the FPCB is fixed to and combined with the vibrating diaphragm so as to directly and electrically connect the leading wires of the voice coils with the pads of the FPCB attached to the vibrating diaphragm, so that the disconnection of the leading wires of the voice coils due to vibration of the vibrating diaphragm can be avoided. Similarly, the driving units and the external circuit are electrically connected by the FPCB connector. Compared to ordinary lead wire connecting manners, by using the FPCB connector can simplify the manufacturing process, save the internal space of the loudspeaker and improve the stability of the loudspeaker.

In the above embodiment II, each of the two voice coil units which are bonded to a group of opposite sides formed by the voice coil units arranged at four corners of the dome portion of the vibrating diaphragm respectively, i.e., two voice coil units in the middle, and two voice coil units which are bonded to the corners of the same side, are equally spaced along a same straight line. Besides, it is also possible to make the two voice coil units in the middle to be close to the central sound hole 7, to be not in the same straight line with the voice coil units bonded to the corners, and to be spaced non-uniformly. With such an arrangement, the driving force of the whole driving units can be more powerful and uniform, and it is also possible to effectively avoid resonance and avoid the drawback caused by resonance of the vibrating diaphragm.

Figure 7:
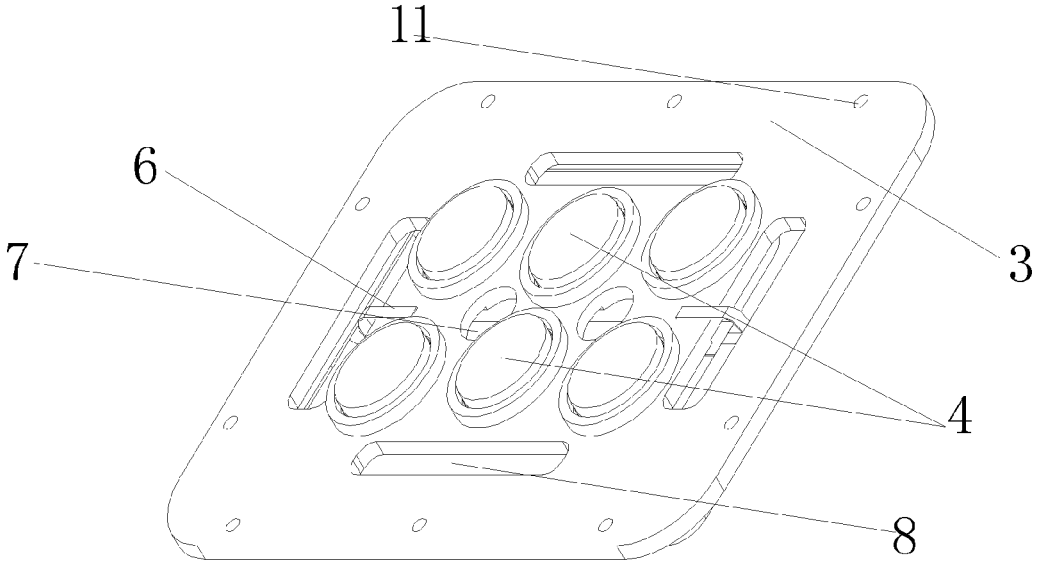
FIG. 7 is an opposite view of the housing and the driving units according to embodiment III.

FIG. 7 is an opposite view showing the housing and the driving units according to embodiment III of the present invention.

In the embodiment III showed in FIG. 7, the difference between the embodiment III and the embodiment II is the arrangement of the driving units. In the embodiment III showed in FIG. 7, the group of driving units in the middle are close to the central sound hole 7, not in the same straight line with the driving units bonded to corners, and arranged non-uniformly.

In the tablet woofer provided by the present invention, as relatively more driving units are used, in order to reasonably connect all of the driving units, two manners below can be utilized:

(1) connecting sequentially voice coil units positioned at each side in series respectively so as to have two branches, and then connecting the two branches in parallel;

(2) connecting sequentially voice coil units positioned at the different sides in series respectively so as to have two branches, and then connecting the two branches in parallel.

Figure 8A:
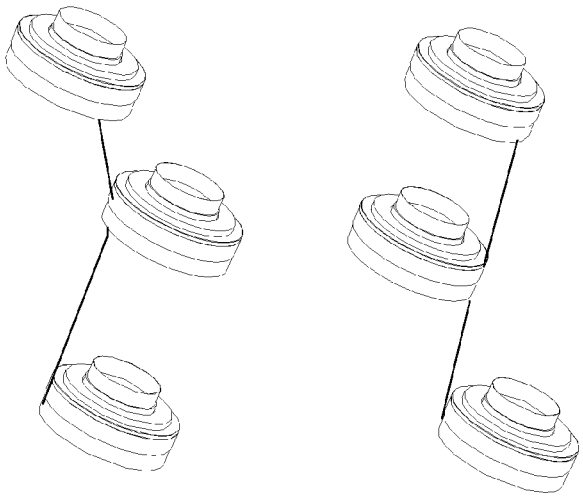
FIGS. 8A and 8B are schematic diagrams showing the two connection types for voice coil units according to the embodiments.
Figure 8B:
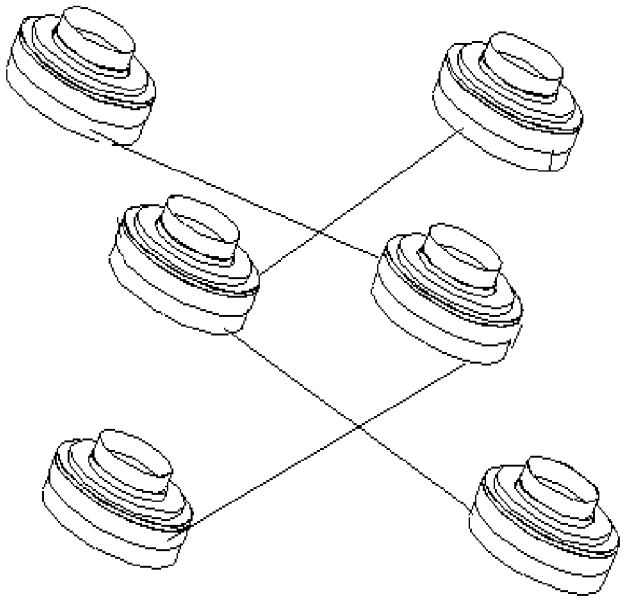

Specifically, as an example, in the embodiment with six driving units showed in FIGS. 6 and 7, the voice coil units are electrically connected in the following manner: connecting sequentially three voice coil units positioned at each side in series respectively so as to have two branches, and then connecting the two branches in parallel, as shown in FIG. 8A; or, two voice coil units bonded to the corners locating on each side are connected in series with the voice coil unit in the middle locating on the opposite side respectively so as to have two branches, and then connecting the two branches in parallel, as shown in FIG. 8B.

According to the connection type of the voice coil units showed in FIG. 8B, if there is something wrong with one or more driving units on the same branch, the tablet woofer can operate normally because there is another branch uniformly distributed around the vibrating diaphragm to make sure the vibrating diaphragm be uniformly forced. Meanwhile, as both ends of the FPCB are relatively thinner and are bent with certain radian, the resistance on the vibrating diaphragm during the vibration of the vibrating diaphragm can be minimized so as to make the vibrating diaphragm uniformly forced.

Figure 9:
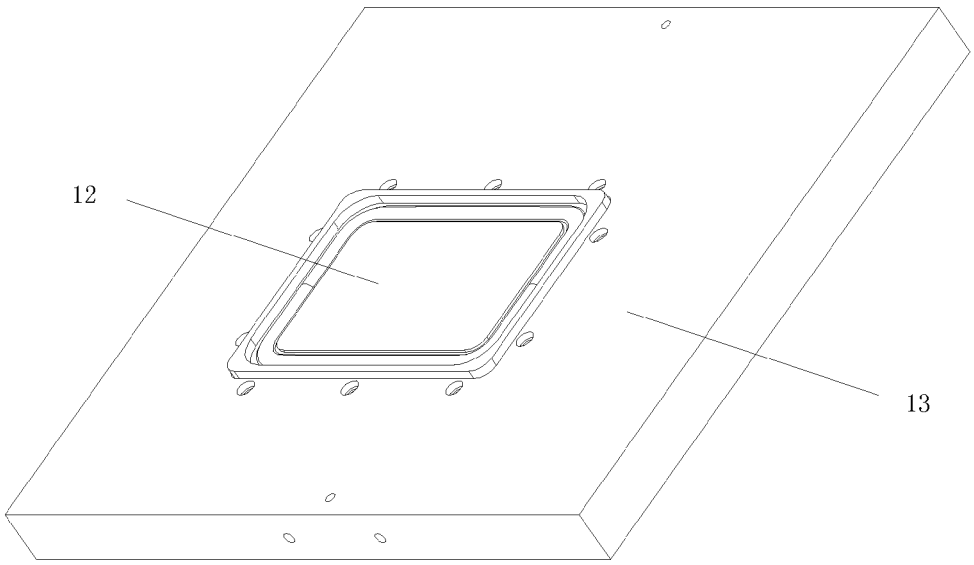
FIG. 9 is a front view of an electronic device which combined the woofer with the peripheral frame for fixing the woofer according to the embodiments.
Figure 10:
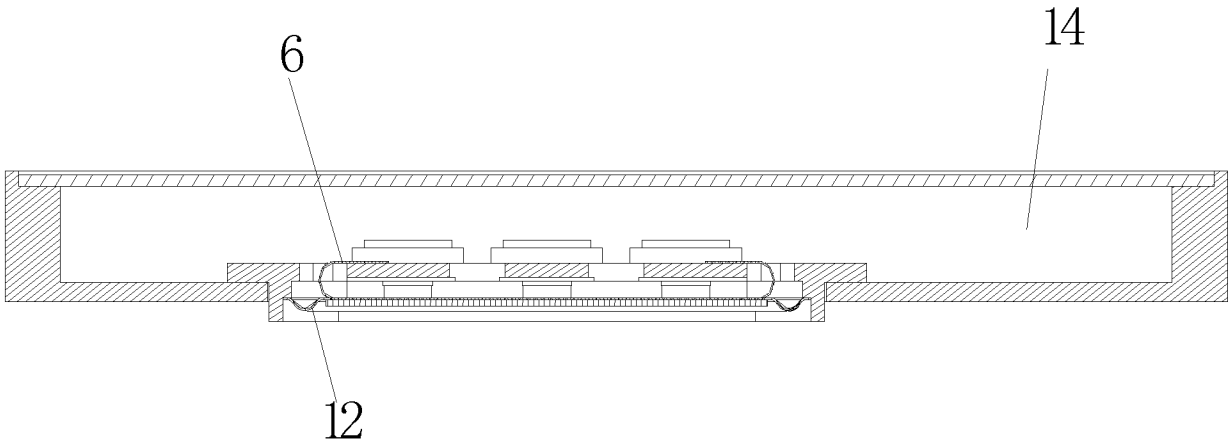
FIG. 10 is a sectional view of an electronic device which combined the woofer with the peripheral frame for fixing the woofer according to one embodiment.

FIGS. 9 and 10 show a front view and a sectional view of an electronic device which is the combination of the woofer and the peripheral frame for fixing the woofer.

As shown in FIGS. 9 and 10, the tablet woofer is installed in an electronic device 13, such as a television, and the electronic device 13, such as a television, is electrically connected to the side of the FPCB connector 6 away from the mounting plane.

As the intermediate part of the FPCB connector 6 is attached to the side of the vibrating diaphragm with voice coils, in the loudspeaker product, the intermediate part of the FPCB connector 6 is positioned at the side of the mounting plane closer to the vibrating diaphragm, and two end parts of the FPCB connector 6 extend from the sound holes to the side of the mounting plane 9 away from the vibrating diaphragm. The sound holes on the mounting plane ensure that the space of the rear side of the vibrating diaphragm 12 is communicated with the whole rear acoustic cavity 14. Acoustic materials or gas adsorption materials can be added in the rear acoustic cavity 14. The acoustic materials can adjust the acoustics curve and the sound performance; and the gas adsorption materials can absorb gas and adjust the gas pressure of the rear acoustic cavity 14, so as to improve the equivalent volume of the rear acoustic cavity 14 and enhance the low-frequency sound effect of the loudspeaker products.

The structure of the tablet woofer is described in details in connection with the accompanying drawings. It can be seen from the aforementioned embodiments, in the tablet woofer, driving units are dispersedly arranged at corners and at the middle position of the dome portion of the vibrating diaphragm; with this structure, the thickness of the woofer can be reduced, the size and cost of the magnet can be reduced, and the sensitivity of the loudspeaker can be improved; a plurality of driving units act on the vibrating diaphragm, the driving force is uniform, the driving power is ensured to be high enough, and the products are thin; the housing is made of aluminum alloy materials which are high in stability; meanwhile, the FPCB connector is used for connecting the voice coils and the external circuit, so that the internal space of the product can be saved in order to make the tablet woofer thinner.

As described above, the tablet woofer and electronic device using the same provided by the present invention is described by way of example with reference to the accompanying drawings. However, it should be understood by those skilled in the art that various improvements can be made to the tablet woofer and electronic device using the same provided by the present invention as described above without depart from the contents of the present invention. Accordingly, the scope of protection of the present invention is determined by the contents of the appended claims.

The invention claimed is:

1. A tablet woofer, comprising a vibrating diaphragm, at least four driving units independent of each other and a housing; wherein, the vibrating diaphragm has a rectangular shape, comprising a rigid dome portion at the central position and a suspension ring portion at the edge position, said dome portion having four sides and four corners;

the driving units comprise voice coil units and magnetic circuit units corresponding to the voice coil units;

four voice coil units are bonded to four corners of the dome portion of the vibrating diaphragm respectively;

mounting holes for accommodating and mounting the driving units, and sound holes penetrating through a mounting plane are arranged on the housing;

the suspension ring portion of the vibrating diaphragm is fixed and coupled to the peripheral region of the upper lateral surface of the housing, wherein, all the voice coil units are electrically connected in following manner:

voice coil units positioned at each side are sequentially electrically connected in series, respectively, so as to form two branches which are connected in parallel; or voice coil units positioned at different sides are sequentially electrically connected in series respectively so as to have two branches which are connected in parallel.

2. The tablet woofer according to claim 1, wherein, the housing comprises a mounting plane and an annular side wall provided around the mounting plane, and mounting holes for accommodating and mounting the driving units and sound holes penetrating through the mounting plane are arranged on the mounting plane;

the upper side surface of the annular side wall is fixedly connected with the suspension ring portion of the vibrating diaphragm.

3. The tablet woofer according to claim 2, wherein, the driving unit has a round shape, comprises a round voice coil unit and a round magnetic circuit unit; and the voice coil unit is bonded to a side of the dome portion closer to the housing.

4. The tablet woofer according to claim 2, wherein, the sound holes comprise central sound holes and edge sound holes;

the central sound holes are arranged in the central position of the mounting plane; and the edge sound holes are arranged between the annual side wall and the mounting holes.

5. The tablet woofer according to claim 1, wherein, the number of the driving units is at least six, the voice coil units of four driving units among the driving units are bonded to four corners of the dome portion of the vibrating diaphragm respectively, and the other voice coil units are respectively bonded to one or two groups of opposite sides of the dome portion.

6. The tablet woofer according to claim 5, wherein, the voice coil units which are bonded to either side of the dome portion and two voice coil units which are bonded to the corners of the same side, are equally spaced along a same straight line; or the spacing between the two voice coil units bonded to central positions of the opposite straight sides of the dome portion is less than the spacing between the two voice coil units bonded to the corners of the dome portion.

7. The tablet woofer according to claim 1, further comprising FPCB connectors electrically connecting an internal circuit of the woofer and an external circuit, wherein, the FPCB connector is clamped and fixed on the mounting plane on the edge of the central sound hole, or attached and fixed to a side of the vibrating diaphragm combined with the voice coil units; and one part of the FPCB connector is positioned at a side of the mounting plane closer to the vibrating diaphragm, and the other part is positioned at a side of the mounting plane away from the vibrating diaphragm.

8. The tablet woofer according to claim 1, wherein, a fixing plane is provided to extend from outer edge of the annular side wall, and fixing holes for coupling with electronic devices are provided on the fixing plane.

9. The tablet woofer according to claim 1, wherein, the dome portion has a honeycomb structure or a foaming body structure;

the suspension ring portion is made of PU or silicon rubber;

the housing is made of aluminum alloy material.

10. An electronic device comprising the tablet woofer according to claim 1 and a peripheral frame for fixing the woofer, wherein, a rear acoustic cavity is formed between the peripheral frame and the woofer;

the rear acoustic cavity is communicated with the space behind the vibrating diaphragm through the sound holes.

11. The electronic device according to claim 10, wherein, acoustic absorbing material or gas adsorption material is provided in the rear acoustic cavity.

12. The tablet woofer according to claim 2, further comprising FPCB connectors electrically connecting an internal circuit of the woofer and an external circuit, wherein:

the FPCB connector is clamped and fixed on a mounting plane on an edge of the central sound hole, or attached and fixed to a side of the vibrating diaphragm combined with the voice coil units; and one part of the FPCB connector is positioned at a side of the mounting plane closer to the vibrating diaphragm, and the other part is positioned at a side of the mounting plane away from the vibrating diaphragm.

13. The tablet woofer according to claim 3, further comprising FPCB connectors electrically connecting an internal circuit of the woofer and an external circuit, wherein:

the FPCB connector is clamped and fixed on a mounting plane on an edge of the central sound hole, or attached and fixed to a side of the vibrating diaphragm combined with the voice coil units; and one part of the FPCB connector is positioned at a side of the mounting plane closer to the vibrating diaphragm, and the other part is positioned at a side of the mounting plane away from the vibrating diaphragm.

14. The tablet woofer according to claim 4, further comprising FPCB connectors electrically connecting an internal circuit of the woofer and an external circuit, wherein:

the FPCB connector is clamped and fixed on a mounting plane on an edge of the central sound hole, or attached and fixed to a side of the vibrating diaphragm combined with the voice coil units; and one part of the FPCB connector is positioned at a side of the mounting plane closer to the vibrating diaphragm, and the other part is positioned at a side of the mounting plane away from the vibrating diaphragm.

15. The tablet woofer according to claim 5, further comprising FPCB connectors electrically connecting an internal circuit of the woofer and an external circuit, wherein:

the FPCB connector is clamped and fixed on a mounting plane on an edge of the central sound hole, or attached and fixed to a side of the vibrating diaphragm combined with the voice coil units; and one part of the FPCB connector is positioned at a side of the mounting plane closer to the vibrating diaphragm, and the other part is positioned at a side of the mounting plane away from the vibrating diaphragm.

16. The tablet woofer according to claim 6, further comprising FPCB connectors electrically connecting an internal circuit of the woofer and an external circuit, wherein:

the FPCB connector is clamped and fixed on a mounting plane on an edge of the central sound hole, or attached and fixed to a side of the vibrating diaphragm combined with the voice coil units; and one part of the FPCB connector is positioned at a side of the mounting plane closer to the vibrating diaphragm, and the other part is positioned at a side of the mounting plane away from the vibrating diaphragm.

* * * * *